US012601067B2

(12) United States Patent
Weinelt et al.

(10) Patent No.: US 12,601,067 B2
(45) Date of Patent: Apr. 14, 2026

(54) ELECTROCHEMICAL OXIDATION OF CYCLOALKENES AND CYCLOALKANES INTO α,ω-DICARBOXYLIC ACIDS OR INTO KETOCARBOXYLIC ACIDS AND CYCLOALKANONE COMPOUNDS

(71) Applicant: Evonik Operations GmbH, Essen (DE)

(72) Inventors: Frank Weinelt, Billerbeck (DE); Franz-Erich Baumann, Duelmen (DE); Siegfried R. Waldvogel, Gau-Algesheim (DE); Joachim Nikl, Frankfurt am Main (DE)

(73) Assignee: Evonik Operations GmbH, Essen (DE)

( * ) Notice: Subject to any disclaimer, the term of this patent is extended or adjusted under 35 U.S.C. 154(b) by 0 days.

(21) Appl. No.: 18/849,121

(22) PCT Filed: Mar. 22, 2023

(86) PCT No.: PCT/EP2023/057344
§ 371 (c)(1),
(2) Date: Sep. 20, 2024

(87) PCT Pub. No.: WO2023/186661
PCT Pub. Date: Oct. 5, 2023

(65) Prior Publication Data

US 2025/0109509 A1 Apr. 3, 2025

(30) Foreign Application Priority Data

Mar. 28, 2022 (EP) ..... 22164755

(51) Int. Cl.

| | |
|---|---|
| ***C25B 3/07*** | (2021.01) |
| ***C25B 3/23*** | (2021.01) |
| ***C25B 9/15*** | (2021.01) |
| ***C25B 9/17*** | (2021.01) |
| ***C25B 11/043*** | (2021.01) |

(52) U.S. Cl.
CPC ..... *C25B 3/07* (2021.01); *C25B 3/23* (2021.01); *C25B 9/15* (2021.01); *C25B 9/17* (2021.01); *C25B 11/043* (2021.01)

(58) Field of Classification Search
CPC ..... C25B 3/07; C25B 3/23
USPC ..... 205/440, 442, 447
See application file for complete search history.

(56) References Cited

U.S. PATENT DOCUMENTS

| | | | |
|---|---|---|---|
| 5,026,461 | A | 6/1991 | Davis et al. |
| 5,236,561 | A | 8/1993 | Wilhoit |
| 5,405,936 | A | 4/1995 | Mumcu et al. |
| 6,149,836 | A | 11/2000 | Mumcu et al. |
| 8,604,227 | B2 | 12/2013 | Petrat et al. |
| 11,976,373 | B2 | 5/2024 | Weinelt et al. |
| 2013/0006005 | A1 | 1/2013 | Petrat et al. |
| 2018/0044804 | A1 * | 2/2018 | Hunter ..... C25B 11/051 |
| 2023/0212762 | A1 | 7/2023 | Weinelt et al. |
| 2023/0235464 | A1 | 7/2023 | Neumann et al. |
| 2025/0109509 | A1 | 4/2025 | Weinelt et al. |
| 2025/0215583 | A1 | 7/2025 | Baumann et al. |
| 2025/0215584 | A1 | 7/2025 | Weinelt et al. |
| 2025/0223709 | A1 | 7/2025 | Weinelt et al. |

FOREIGN PATENT DOCUMENTS

| | | | |
|---|---|---|---|
| CN | 104032327 | 6/2016 | |
| DE | 40 29 068 | 3/1992 | |
| JP | 2019-099861 | 6/2019 | |
| WO | 2021/260679 | 12/2021 | |
| WO | WO-2021260679 A1 * | 12/2021 | ..... B01J 23/002 |
| WO | 2024/227775 A1 | 11/2024 | |
| WO | 2024/227776 A1 | 11/2024 | |

OTHER PUBLICATIONS

Bäumer et al., "Cleavage of alkenes by anodic oxidation", Journal of Applied Electrochemistry, vol. 35, Jun. 1, 2005, pp. 1283-1292.
Bäumer et al., "Cleavage of olefinic double bonds by mediated anodic oxidation", Electrochimica Acta, vol. 48, 2003, pp. 489-495.
Dörr et al., "Screening in der Elektrosynthese", Elektrosynthese, vol. 7, Aug. 2021, pp. 26-28.
European Search Report received for European Patent Application No. 22164755.5, mailed on Nov. 17, 2022, 9 pages.
Gütz et al., "Electrochemical Screening for Electroorganic Synthesis", Org. Process Res. Dev., vol. 20, Dec. 9, 2015, pp. 26-32.
International Search Report received for PCT Application No. PCT/EP2023/057344, mailed on Jul. 14, 2023, 7 pages with English translation.
Kirste et al., "Anodic Phenol—Arene Cross-Coupling Reaction on Boron-Doped Diamond Electrodes", Angew. Chem. Int. Ed., vol. 49, 2010, pp. 971-975.
Kirste et al., "Anodische Phenol-Aren-Kreuzkupplung an bordotierten Diamantelektroden", Angew. Chem., vol. 122, 2010, pp. 983-987.
Written Opinion received for PCT/EP2023/057344, mailed on Jul. 14, 2023, 13 pages with English translation.
U.S. Appl. No. 18/850,115, filed Sep. 24, 2024, 2025/0215583, Baumann et al.

(Continued)

*Primary Examiner* — Edna Wong

(74) *Attorney, Agent, or Firm* — Grüneberg Global IP, PLLC

(57) ABSTRACT

A process produces unsubstituted or at least monosubstituted α,ω-dicarboxylic acids or ketocarboxylic acids and unsubstituted or at least monosubstituted cycloalkanones by electrochemical oxidation of unsubstituted or at least monosubstituted, monounsaturated or poly unsaturated cycloalkenes and unsubstituted or at least monosubstituted, saturated cycloaliphatic hydrocarbons in the presence of an inorganic or organic nitrate salt in an electrolysis cell in a reaction medium in the presence of oxygen.

21 Claims, No Drawings

(56) References Cited

OTHER PUBLICATIONS

U.S. Appl. No. 18/851,145, filed Sep. 26, 2024, 2025/0215584, Weinelt et al.
U.S. Appl. No. 18/849,121, filed Sep. 20, 2024, 2025/0109509, Weinelt et al.
U.S. Appl. No. 18/849,610, filed Sep. 23, 2024, 2025/0223709, Weinelt et al.
Office Action received for U.S. Appl. No. 18/851,145, mailed on Aug. 21, 2025, 8 pages.

* cited by examiner

ELECTROCHEMICAL OXIDATION OF CYCLOALKENES AND CYCLOALKANES INTO α,ω-DICARBOXYLIC ACIDS OR INTO KETOCARBOXYLIC ACIDS AND CYCLOALKANONE COMPOUNDS

CROSS-REFERENCE TO RELATED APPLICATIONS

This application is a National Stage entry under § 371 of International Application No. PCT/EP2023/057344, filed on Mar. 22, 2023, and which claims the benefit of priority to European Patent Application No. 22164755.5, filed on Mar. 28, 2022. The content of each of these applications is hereby incorporated by reference in its entirety.

BACKGROUND OF THE INVENTION

Field of the Invention

The present invention relates to a process for producing unsubstituted or at least monosubstituted α,ω-dicarboxylic acids or ketocarboxylic acids and unsubstituted or at least monosubstituted cycloalkanones by electrochemical oxidation of unsubstituted or at least monosubstituted, monounsaturated or polyunsaturated cycloalkenes and unsubstituted or at least monosubstituted, saturated cycloaliphatic hydrocarbons in the presence of an inorganic or organic nitrate salt in an electrolysis cell in a reaction medium in the presence of oxygen.

α,ω-Dicarboxylic acids, ketocarboxylic acids and cycloalkanone compounds are important substrates for organic synthetic chemistry and monomer components for polymer syntheses and are therefore highly relevant to industrial applications. The conventional route to these substrates is essentially from cycloalkanes and cycloalkenes via transition metal-catalyzed reactions and using chemical oxidants.

Description of Related Art

A method of electrochemical oxidation of cycloalkanes to the corresponding ketones has not yet been described. Only a few examples of electrochemical, oxidative double bond cleavage of cyclooctene and cyclododecene to form dicarboxylic acids/their methyl esters are known (U. Baumer, Electrochimica Acta 2003, 48, 489-495; U.-St. Bäumer, H. J. Schäfer, J. Appl. Electrochem. 2005, 35, 1283-1292; D. D. Davis, D. L. Sullivan. Process for the Preparation of Dodecanedionic Acid, 1991 and U.S. Pat. No. 5,026,461 A). The synthesis of dicarboxylic acids through oxidative double bond cleavage proceeds from pure cycloalkenes.

In these prior art processes, synthesis moreover often affords the corresponding carboxylic esters and generation of the free carboxylic acids therefore often requires a further step of hydrolysis which requires additional time and resources.

The use of costly transition metals as electrocatalysts or as electrode materials and the use of chemical oxidants result, due to increased material input, in generated reagent wastes which in some cases require costly and complex disposal or regeneration. The processes further require an altogether high material input through the use of complex electrolyte systems and additional oxidants, thus altogether having an adverse effect on the cost balance and the economy of the process.

SUMMARY OF THE INVENTION

It is an object of the present invention to provide a sustainable and resource-saving process which makes it possible to produce α,ω-dicarboxylic acids and cycloalkanones.

This object was achieved by the subject-matter of the embodiments and the description herein.

The present invention provides a process for producing unsubstituted or at least monosubstituted α,ω-dicarboxylic acids or ketocarboxylic acids and unsubstituted or at least monosubstituted cycloalkanones by electrochemical oxidation comprising the process steps of:

(a-1) providing at least one unsubstituted or at least monosubstituted, monounsaturated or polyunsaturated cycloalkene;

(a-2) providing at least one unsubstituted or at least monosubstituted, saturated cycloaliphatic hydrocarbon;

(b) providing at least one inorganic or organic nitrate salt;

(c) electrochemically oxidizing the unsubstituted or at least monosubstituted, monounsaturated or polyunsaturated cycloalkene provided in step (a-1) and the unsubstituted or at least monosubstituted, saturated cycloaliphatic hydrocarbon provided in step (a-2) in the presence of the inorganic or organic nitrate salt provided in step (b) in an electrolysis cell in a reaction medium in the presence of oxygen.

It has surprisingly been found that the process according to the invention makes it possible to electrochemically oxidize cyclic alkenes in the presence of cyclic alkanes of the same ring size to afford α,ω-dicarboxylic acids/ketocarboxylic acids.

The process according to the invention thus makes it possible to convert industrially obtained cycloalkenes which often contain a certain proportion of cycloaliphatic hydrocarbons into α,ω-dicarboxylic acids, wherein cyclic ketones which may likewise be utilized in industrial applications are obtained as further products.

The process according to the invention thus allows simplification of industrially relevant processes and further results in possible process optimization from a sustainability standpoint.

The present invention makes it possible to achieve a resource-saving, synthetically relevant oxo-functionalization of feedstock chemicals, wherein the use of environmentally harmful transition metals and oxidants is largely avoided. The selective conversion to the desired products and the effective use of conductivity salt and mediator in a dual function thus considerably reduce the generation of costly reagent wastes. The present invention allows an electrochemical synthetic route to aliphatic α,ω-carboxylic acids, ketocarboxylic acids and cycloalkanones by means of an effective, convergent electrolysis where both electrode reactions have synthetic utility.

The process of the invention has the particular features of high selectivity, small amounts of auxiliary chemicals used, the use of electric current as oxidizing agent and, associated therewith, the generation of smaller amounts of waste products.

It was additionally surprisingly found that the process according to the invention can be carried out at ambient pressure and ambient temperature, which is likewise advantageous for energy efficiency and thus for environmental compatibility too.

DETAILED DESCRIPTION OF THE INVENTION

The process according to the invention may employ unsubstituted or at least monosubstituted, monounsaturated or polyunsaturated cycloalkenes which are monocyclic or bicyclic. It is preferable to employ unsubstituted or at least monosubstituted, monounsaturated or polyunsaturated monocyclic cycloalkenes, wherein unsubstituted or at least monosubstituted, monounsaturated monocyclic cycloalkenes are particularly preferred. The position of the unsaturated bonds may be endocyclic or exocyclic, wherein endocyclic unsaturated bonds are preferred.

The unsubstituted or at least monosubstituted, monounsaturated or polyunsaturated monocyclic cycloalkenes employed in the process according to the invention may preferably have 5 to 12 carbon atoms, particularly preferably 6 to 12 carbon atoms, very particularly preferably 8 to 12 carbon atoms, in the ring system. These cycloalkenes may be monounsaturated or polyunsaturated, wherein monounsaturated cycloalkenes are preferred. These cycloalkenes may each be unsubstituted or monosubstituted or polysubstituted. Where they are monosubstituted or polysubstituted, they are preferably substituted with 1, 2, 3, 4 or 5 substituents, each independently selected from the group consisting of methyl, phenyl or benzyl. The phenyl or benzyl substituents may themselves each be unsubstituted or monosubstituted or polysubstituted with 1, 2 or 3 substituents, each independently selected from the group consisting of F, Cl, Br and $NO_2$.

The unsubstituted or at least monosubstituted, monounsaturated or polyunsaturated bicyclic cycloalkenes employed in the process according to the invention may preferably have 7 to 18 carbon atoms, particularly preferably 7 to 12 carbon atoms, very particularly preferably 7 to 10 carbon atoms, in the ring system. These cycloalkenes may be monounsaturated or polyunsaturated, wherein monounsaturated cycloalkenes are preferred. These cycloalkenes may each be unsubstituted or monosubstituted or polysubstituted. Where they are monosubstituted or polysubstituted, they are preferably substituted with 1, 2, 3, 4 or 5 substituents, each independently selected from the group consisting of methyl, phenyl or benzyl. The phenyl or benzyl substituents may themselves each be unsubstituted or monosubstituted or polysubstituted with 1, 2 or 3 substituents, each independently selected from the group consisting of F, Cl, Br and $NO_2$.

Where the monocyclic or bicyclic cycloalkenes employed according to the invention or substituents thereof comprise alkyl radicals having more than one carbon atom in the side chain, the performance of the process according to the invention can result in the occurrence of undesired side reactions in these substituents.

The monocyclic cycloalkene may very particularly preferably be selected from the group consisting of cyclohexene, cycloheptene, cyclooctene, cyclononene, cyclodecene, cycloundecene, cyclododecene and 1-phenylcyclohex-1-ene. Particularly preferred bicyclic cycloalkenes may be selected from the group consisting of bicylo[2.2.1]hept-2-ene, α-pinene and carene.

The process according to the invention may employ unsubstituted or at least monosubstituted, saturated cycloaliphatic hydrocarbons which are monocyclic or bicyclic, preferably bicyclic. Particular preference is given to using monocyclic cycloaliphatic hydrocarbons in the process according to the invention.

The monocyclic or polycyclic, especially monocyclic or bicyclic, saturated cycloaliphatic hydrocarbons used in the process according to the invention may preferably have 5 to 18 carbon atoms in the ring system. These cycloaliphatic hydrocarbons may each be unsubstituted or they may be monosubstituted or polysubstituted. Where they are monosubstituted or polysubstituted, they are preferably substituted with 1, 2, 3, 4 or 5 substituents, each independently selected from the group consisting of methyl, phenyl or benzyl. The phenyl or benzyl substituents may themselves each be unsubstituted or monosubstituted or polysubstituted with 1, 2 or 3 substituents, each independently selected from the group consisting of F, Cl, Br and $NO_2$. Where the cycloaliphatic hydrocarbons used according to the invention or substituents thereof contain alkyl radicals having more than one carbon atom in the side chain, performance of the process according to the invention can result in the occurrence of undesired side reactions in these substituents.

The process according to the invention particularly preferably employs as unsubstituted or at least monosubstituted, saturated cycloaliphatic hydrocarbons monocyclic saturated hydrocarbons having 6 to 12 carbon atoms in the ring, preferably having 8 to 12 carbon atoms in the ring, that are unsubstituted or monosubstituted or polysubstituted with 1, 2, 3, 4 or 5 substituents, each independently selected from the group consisting of methyl, phenyl or benzyl. The process according to the invention very particularly preferably employs monocyclic saturated hydrocarbons having 8 to 12 carbon atoms in the ring that are unsubstituted or monosubstituted or disubstituted or trisubstituted with a methyl group.

The saturated monocyclic hydrocarbon is very particularly preferably unsubstituted and selected from the group consisting of cyclohexane, cycloheptane, cyclooctane, cyclononane, cyclodecane, cycloundecane and cyclododecane, yet more preferably selected from the group consisting of cyclooctane, cyclononane, cyclodecane, cycloundecane and cyclododecane, and most preferably is cyclododecane.

It is particularly preferable when the cycloalkene is selected from the group consisting of cyclohexene, cycloheptene, cyclooctene, cyclononene, cyclodecene, cycloundecene, cyclododecene, 1-phenylcyclohex-1-ene, bicylo[2.2.1]hept-2-ene, α-pinene and carene and the saturated cycloaliphatic hydrocarbon is selected from the group consisting of cyclohexane, cycloheptane, cyclooctane, cyclononane, cyclodecane, cycloundecane and cyclododecane.

It is very particularly preferable when the cycloalkene is cyclododecene and the saturated cycloaliphatic hydrocarbon is cyclododecane.

The providing of at least one unsubstituted or at least monosubstituted, monounsaturated or polyunsaturated cycloalkene according to step (a-1) and the providing of at least one unsubstituted or at least monosubstituted, saturated cycloaliphatic hydrocarbon according to step (a-2) may preferably be carried out in combination, particularly preferably as a mixture, in the process according to the invention. Thus for example precursor products from industrial scale processes which contain these two constituents may be employed directly in the process according to the invention.

The quantity ratio of the unsubstituted or at least monosubstituted, monounsaturated or polyunsaturated cycloalkene and the unsubstituted or at least monosubstituted, saturated cycloaliphatic hydrocarbon in the process according to the invention may vary over a wide range.

It is preferable when the molar proportion of the unsubstituted or at least monosubstituted, monounsaturated or polyunsaturated cycloalkene is 40 to 95 mol %, preferably 45 to 55 mol %, particularly preferably 47 to 53 mol %, in each case based on the total amount of employed unsubstituted or at least monosubstituted, monounsaturated or polyunsaturated cycloalkene and unsubstituted or at least monosubstituted, saturated cycloaliphatic hydrocarbon.

It is likewise preferable when the molar proportion of the unsubstituted or at least monosubstituted, monounsaturated or polyunsaturated cycloalkene is >60 mol %, preferably >65 mol %, particularly preferably >70 mol %, in each case based on the total amount of employed unsubstituted or at least monosubstituted, monounsaturated or polyunsaturated cycloalkene and unsubstituted or at least monosubstituted, saturated cycloaliphatic hydrocarbon.

It is very particularly preferable to employ cyclododecene in an amount of 90 to 95 mol % as the cycloalkene and cyclododecane in an amount of 5 to 10 mol % as the saturated cycloaliphatic hydrocarbon, based on the total amount of cyclodecene and cyclodecane.

Step (b) of the process according to the invention comprises providing at least one inorganic or organic nitrate salt. This nitrate salt functions both as the conducting salt and as the mediator of the electrochemical oxidation process according to the invention. Preference is given to using an inorganic or organic salt of the general formula $$[\text{cation}^+][NO_3^-]$$

where the [cation$^+$] is selected from the group consisting of $Na^+$, $K^+$ and ammonium ions having the general structure $[R^1R^2R^3R^4N^+]$ where $R^1$, $R^2$, $R^3$ and $R^4$ are each independently selected from the group consisting of $C_1$ to $C_{16}$ alkyl, especially $C_1$ to $C_8$ alkyl, straight-chain or branched, imidazolium cations of the general structure (1)

(I)

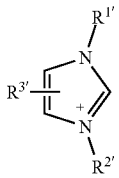

where $R^{1'}$ and $R^{2'}$ are each independently selected from the group consisting of $C_1$ to $C_{18}$ alkyl, straight-chain or branched, especially $C_1$ to $C_8$ alkyl, straight-chain or branched, and $R^{3'}$ is selected from the group consisting of H and $C_1$ to $C_{18}$ alkyl, straight-chain or branched, especially from the group consisting of H and $C_1$ to $C_8$ alkyl, straight-chain or branched, pyridinium cations of the general structure (II)

(II)

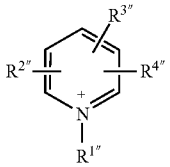

where $R^{1''}$ is selected from the group consisting of $C_1$ to $C_{18}$ alkyl, especially $C_1$ to $C_8$ alkyl, straight-chain or branched, and $R^{2''}$, $R^{3''}$ and $R^{4''}$ are each independently selected from the group consisting of H and $C_1$ to $C_{18}$ alkyl, straight-chain or branched, especially from the group consisting of H and $C_1$ to $C_8$ alkyl, straight-chain or branched, and phosphonium ions having the general structure $[R^{1a}R^{2a}R^{3a}R^{4a}P^+]$ where $R^{1a}$, $R^{2a}$, $R^{3a}$, $R^{4a}$ are each independently selected from the group consisting of $C_1$ to $C_{16}$ alkyl, especially $C_1$ to $C_8$ alkyl, straight-chain or branched.

Where an organic nitrate based on imidazolium cations is used in the process according to the invention, preference is given to cations of the general formula (I) in which $R^{1'}$ and $R^{2'}$ are each independently selected from the group consisting of $C_1$ to $C_{18}$ alkyl, straight-chain or branched, especially $C_1$ to $C_8$ alkyl, straight-chain or branched and $R^{3'}$ is hydrogen. Particularly preferred are imidazolium cations of the general formula (1) in which $R^{1'}$ is methyl and $R^{2'}$ is ethyl or $R^{1'}$ is methyl and $R^{2'}$ is methyl or $R^{1'}$ is methyl and $R^{2'}$ is butyl and $R^{3'}$ is hydrogen in each case.

Where a nitrate based on pyridinium cations is used in the process according to the invention, preference is given to cations of the general formula (II) in which $R^{1''}$ is $C_1$- to $C_{18}$-alkyl, straight-chain or branched, especially $C_1$- to $C_8$-alkyl, straight-chain or branched. Particularly preferred are pyridinium cations of the general formula (II) in which $R^{1''}$ is $C_1$- to $C_{18}$-alkyl, straight-chain or branched, especially $C_1$- to $C_8$-alkyl, straight-chain or branched, and the radicals $R^{2''}$, $R^{3''}$, and $R^{4''}$ are each independently selected from the group consisting of $C_1$- to $C_8$-alkyl, straight-chain or branched, wherein monosubstitution in the 2-, 3- or 4-position, disubstitution in the 2,4-, 2,5- or 2,6-position or trisubstitution in the 2,4,6-position is preferred.

It is in principle also possible to use two or more of the abovementioned nitrate salts in the process according to the invention. Preference is given to using a nitrate salt according to the invention, especially an organic ammonium nitrate salt of composition $[R^1R^2R^3R^4N^+][NO_3^-]$ or an organic phosphonium salt of composition $[R^{1a}R^{2a}R^{3a}R^{4a}P^+][NO_3^-]$, particular preference being given to an organic ammonium nitrate salt of composition $[R^1R^2R^3R^4N^+][NO_3^-]$.

It is very particularly preferable when the organic ammonium nitrate salt is tetra-n-butylammonium nitrate or methyltri-n-octylammonium nitrate. The organic phosphonium nitrate salt is very particularly preferably tetra-n-butylphosphonium nitrate or methyltri-n-octylphosphonium nitrate. The organic imidazolium nitrate salt is preferably 1-butyl-3-methylimidazolium nitrate.

The organic nitrate salt employed in the process according to the invention is most preferably tetra-n-butylammonium nitrate or methyltri-n-octylammonium nitrate.

The sequence in which the components used in the process according to the invention are provided may vary, as can the sequence in which the individual components are brought into contact with each other or with the respective reaction medium.

In one embodiment of the process according to the invention, the unsubstituted or at least monosubstituted, monounsaturated or polyunsaturated cycloalkene and the unsubstituted or at least monosubstituted, saturated cycloaliphatic hydrocarbon are initially charged and combined with the reaction medium, preferably partially or completely dissolved in the reaction medium or mixed therewith, and the inorganic or organic nitrate salt is subsequently added.

In a further embodiment of the process according to the invention, the inorganic or organic nitrate salt is initially charged and combined with the reaction medium, preferably partially or completely dissolved in the reaction medium or mixed therewith, and the unsubstituted or at least monosubstituted, monounsaturated or polyunsaturated cycloalkene and the unsubstituted or at least monosubstituted, saturated cycloaliphatic hydrocarbon, preferably in combination, are subsequently added.

It is likewise possible that the unsubstituted or at least monosubstituted, monounsaturated or polyunsaturated cycloalkene and the unsubstituted or at least monosubstituted, saturated cycloaliphatic hydrocarbon and the inorganic or organic nitrate salt is initially charged and subsequently combined with the reaction medium, preferably at least partially or completely dissolved in the reaction medium or mixed therewith. It is further also possible that in the process according to the invention the unsubstituted or at least monosubstituted, monounsaturated or polyunsaturated cycloalkene and the unsubstituted or at least monosubstituted, saturated cycloaliphatic hydrocarbon and the inorganic or organic nitrate salt are added to the reaction medium, preferably at least partially or completely dissolved in the reaction medium or mixed therewith, simultaneously or consecutively.

The reaction medium used in the process according to the invention is liquid under the conditions under which the process is carried out and is capable of partially or completely dissolving the components used, i.e. especially the unsubstituted or at least monosubstituted, saturated cycloaliphatic hydrocarbon and the inorganic or organic nitrate salt. Where at least one of these components is used in liquid form, the reaction medium is preferably readily miscible with said component(s).

The process according to the invention preferably employs a polar aprotic reaction medium for the electrochemical oxidation. This may be employed in anhydrous form, in dried form or else in combination with water.

Where an inorganic nitrate salt, especially potassium nitrate or sodium nitrate, is used in the process according to the invention, the reaction medium advantageously contains water, preference being given to an aprotic reaction medium in combination with water. The water content in the reaction medium may vary. The water content is preferably up to 20% by volume, particularly preferably up to 15% by volume, very particularly preferably up to 10% by volume, yet more preferably up to 5% by volume, in each case based on the total amount of reaction medium.

The polar aprotic reaction medium is preferably selected from the group consisting of aliphatic nitriles, aliphatic ketones, cycloaliphatic ketones, dialkyl carbonates, cyclic carbonates, lactones, aliphatic nitroalkanes, dimethyl sulfoxide, esters and ethers or a combination of at least two of these components.

The reaction medium is particularly preferably selected from the group consisting of acetonitrile, isobutyronitrile, adiponitrile, acetone, dimethyl carbonate, methyl ethyl ketone, 3-pentanone, cyclohexanone, nitromethane, nitropropane, tert-butyl methyl ether, dimethyl sulfoxide, gamma-butyrolactone and epsilon-caprolactone or a combination of at least two of these components.

The reaction medium is very particularly preferably selected from the group consisting of acetonitrile, isobutyronitrile, adiponitrile, dimethyl carbonate and acetone or a combination of at least two of these components.

The reaction medium is very particularly preferably acetonitrile, isobutyronitrile or adiponitrile in dried or anhydrous form.

The reaction medium is likewise very particularly preferably acetonitrile, isobutyronitrile or adiponitrile, optionally in combination with water.

Where one or more of the abovementioned components is used in the reaction medium in combination with water, the water content is preferably up to 20% by volume, particularly preferably up to 15% by volume, very particularly preferably up to 10% by volume, yet more preferably up to 5% by volume, in each case based on the total amount of reaction medium.

To perform the process according to the invention it may be advantageous to add further solubilizing components to the reaction medium. Suitable advantageous components may be identified through simple preliminary tests of dissolution behaviour.

Examples of solubilizing components are primary alcohols, secondary alcohols, monoketones or dialkyl carbonates or mixtures of at least two of these components, optionally in combination with water. The process according to the invention may preferably employ $C_{1-6}$ alcohols, wherein particularly preferred solubilizing components may be selected from the group consisting of methanol, ethanol, isopropanol, 2-methyl-2-butanol or mixtures of at least two of these components, optionally in combination with water.

The reaction medium employed may particularly advantageously be dimethyl carbonate, optionally in combination with at least one $C_{1-6}$ alcohol, in particular selected from the group consisting of methanol, ethanol, isopropanol and 2-methyl-2-butanol, optionally in combination with water.

Where one or more of these solubilizing components is used in combination with water, the water content is preferably up to 20% by volume, particularly preferably up to 15% by volume, very particularly preferably up to 10% by volume, yet more preferably up to 5% by volume, in each case based on the total amount of solubilizing component and water.

The solubilizing components may be added in amounts of preferably <50% by volume, particularly preferably of <30% by volume, very particularly preferably of <10% by volume, in each case based on the total amount of reaction medium.

The inorganic or organic nitrate salt in the process according to the invention is preferably employed in an amount of 0.1 to 2.0, preferably 0.2 to 1.0, particularly preferably 0.3 to 0.8 and very particularly preferably 0.4 to 0.8, equivalents based on the amount of employed unsubstituted or at least monosubstituted, monounsaturated or polyunsaturated cycloalkene and in an amount of 0.8 to 10.0, preferably 2.5 to 10.0, particularly preferably 3.0 to 10.0 and very particularly preferably 5.0 to 10.0 equivalents based on the amount of employed unsubstituted or at least monosubstituted, saturated cycloaliphatic hydrocarbon.

According to the invention, the electrochemical oxidation of the unsubstituted or at least monosubstituted, saturated cycloaliphatic hydrocarbon is carried out in the presence of the inorganic or organic nitrate salt in an electrolysis cell in a reaction medium in the presence of oxygen.

To this end a gas atmosphere containing oxygen is advantageously provided in spatial connection with the reaction medium.

The proportion of oxygen in the gas atmosphere may vary. The proportion of oxygen in the gas atmosphere is preferably 10% to 100% by volume, particularly preferably 15% to 30% by volume, particularly preferably 15% to 25% by volume, very particularly preferably 18% to 22% by volume.

In one embodiment, the proportion of oxygen in the gas atmosphere may be 10% to 100% by volume, particularly preferably 15% to 100% by volume, particularly preferably 20% to 100% by volume.

It is very particularly preferable when the gas atmosphere is air.

It is advantageous when gas exchange between the gas atmosphere and the reaction medium is forced, preferably by introducing gas atmosphere into the reaction medium or by stirring the liquid phase in the presence of the gas atmosphere.

The gas exchange between the gas atmosphere and the reaction medium, especially the stirring, can be used to control the electrochemical oxidation, for example via the geometry of the stirrer or the stirrer speed.

The amount of oxygen dissolved in the reaction medium is preferably at least 1 mmol/L of reaction medium, particularly preferably at least 5 mmol/L of reaction medium.

It is likewise preferable when the amount of oxygen dissolved in the reaction medium is at least 10 mmol/L of reaction medium.

The process according to the invention for producing unsubstituted or at least monosubstituted α,ω-dicarboxylic acids or ketocarboxylic acids and unsubstituted or at least monosubstituted cycloalkanones by electrochemical oxidation of unsubstituted or at least monosubstituted, monounsaturated or polyunsaturated cycloalkenes and unsubstituted or at least monosubstituted, saturated cycloaliphatic hydrocarbons in the presence of an inorganic or organic nitrate salt in an electrolysis cell in a reaction medium in the presence of oxygen may be performed either in a divided electrolysis cell or in an undivided electrolysis cell, wherein performance in an undivided electrolysis cell is preferred.

The undivided electrolysis cell preferably used according to the invention has at least two electrodes. Anodes and cathodes made of customary materials may be used for this purpose, for example ones made of glassy carbon, boron-doped diamond (BDD) or graphite. The use of glassy carbon electrodes is preferred.

The undivided electrolysis cell preferably comprises at least one glassy carbon anode or at least one glassy carbon cathode. It is preferable when both the anode and the cathode are glassy carbon electrodes.

The distance between the electrodes may vary over a certain range. The distance is preferably 0.1 mm to 2.0 cm, particularly preferably 0.1 mm to 1.0 cm, particularly preferably 0.1 mm to 0.5 cm.

The process according to the invention may further be performed batchwise or continuously, preferably in an undivided flow-through electrolysis cell.

It is preferable when the process according to the invention is performed with a charge quantity of at least 190 C (2 F) to 970 C (10 F), preferably 290 C (3 F) to 870 C (9 F), particularly preferably 330 C (3.5 F) to 820 C (8.5 F), very particularly preferably 380 C (4 F) to 775 C (8 F), most preferably 380 C (4 F) to 580 C (6 F), in each case for 1 mmol of employed unsubstituted or at least monosubstituted, monounsaturated or polyunsaturated cycloalkene and unsubstituted or at least monosubstituted, saturated cycloaliphatic hydrocarbon.

The electrochemical oxidation in the process according to the invention is preferably carried out at constant current.

The current density at which the process according to the invention is carried out is preferably at least 5 mA/cm$^2$ or at least 10 mA/cm$^2$ or at least 15 mA/cm$^2$ or at least mA/cm$^2$, or 20 mA/cm$^2$ to 50 mA/cm$^2$, wherein the reported surface area refers to the geometric area of the electrodes.

An important advantage of the process according to the invention is that the oxidant employed is electric current, which is a particularly environmentally friendly agent when it derives from renewable sources, i.e. especially from biomass, solar thermal energy, geothermal energy, hydropower, wind power or photovoltaics in particular.

The process according to the invention may be performed over a wide temperature range, for example at a temperature in the range from 0° to 60° C., preferably of 5° C. to 50° C., particularly preferably 10° C. to 40° C., very particularly preferably at 15° C. to 30° C.

The process according to the invention may be performed at elevated or reduced pressure. Where the process according to the invention is performed at elevated pressure, a pressure up to 16 bar is preferred and a pressure up to 6 bar is particularly preferred.

The process according to the invention may likewise preferably be performed at atmospheric pressure.

The products produced by the process according to the invention may be isolated/purified by customary processes known to those skilled in the art, especially by extraction, crystallization, centrifugation, precipitation, distillation, evaporation or chromatography.

The process according to the invention is preferably performed without the addition of catalysts, in particular without the addition of transition metal catalysts.

It is likewise preferable when the process according to the invention is performed such that, with the exception of oxygen or atmospheric oxygen, no further oxidants are added.

The following examples further elucidate the present invention but are not intended to limit the scope of the invention.

General Information and Methods

Chemicals of analytical quality were obtained from commonly used suppliers (such as TCI, Aldrich and Acros) and used. Oxygen was obtained in 2.5 quality from Nippon Gases Deutschland GmbH, Dûsseldorf, Germany and used as is.

The electrode material used was glassy carbon (Sigradur® G, from HTW Hochtemperatur Werkstoffe GmbH, Thierhaupten, Germany).

High-performance liquid chromatography was carried out on a Shimadzu HPLC-MS instrument with a SIL 20A HT autosampler, a CTO-20AC column oven, two LC-20AD pump modules for adjusting the eluent gradient, a SPD-M20A diode array detector, a CBM-20A system controller and a Eurospher II 100-5 C18 column (150×4 mm, Knauer, Berlin). Eluent: Acetonitrile (ACN)/water/formic acid (1% by volume) (from 10% ACN to 90% ACN in 10 min+10 min 100% ACN). Mass spectrometric measurements were carried out on a LCMS-2020 instrument from Shimadzu, Japan.

$^1$H-NMR and $^{13}$C-NMR spectra were recorded at 25° C. with a Bruker Avance II 400 instrument (400 MHz, 5 mm BBFO probe with Z-gradient and ATM, SampleXPress 60 autosampler, Analytische Messtechnik, Karlsruhe, Germany).

Gas chromatography analyses were performed using a Shimadzu GC-2025 instrument (Shimadzu, Japan) fitted with an HP 5MS column (Agilent Technologies, Santa Clara, California; length: 30 m; internal diameter: 0.25 mm, film thickness: 0.25 μm, carrier gas: hydrogen). GC-MS measurements were performed using a Shimadzu GC-2010 instrument (Shimadzu, Japan) fitted with an HP-1 column (Agilent Technologies, Santa Clara, California; length: 30 m; internal diameter: 0.25 mm, film thickness: 0.25 μm, carrier gas: helium). Sample preparation for GC analysis comprised performing a column filtration through silica gel 60 M (0.04-0.063 mm, Macherey-Nagel GmbH & Co. KG, Duren, Germany).

The undivided Teflon cells used for the electrolysis are described in the literature (a) C. Gütz, B. Klöckner, S. R. Waldvogel, Org. Process Res. Dev. 2016, 20, 26-32; b) A.

Kirste, G. Schnakenburg, F. Stecker, A. Fischer, S. R. Waldvogel, Angew. Chem. Int. Ed. 2010, 49, 971-975; Angew. Chem. 2010, 122, 983-987. (see SI).) The full range of these cells is also commercially available as IKA Screening System (IKA-Werke GmbH & Co. KG, Staufen, Germany). The electrode dimensions were 7 cm×1 cm×0.3 cm.

Gases were introduced in a controlled manner via two model 5850S mass-flow controllers (MFCs) from Brooks Instrument B. V., Veenendaal, The Netherlands. This was done using one controller for the introduction of oxygen and one for the introduction of nitrogen. The controllers were controlled by means of Smart DDE and Matlab R2017b software. Volume flows were additionally monitored via a DK800 float-principle flowmeter from Krohne Messtechnik GmbH, Duisburg. For all experiments performed the overall volume flow was a constant 20 mL/min, which, limited by the MFCs used, also represents the maximum achievable volume flow. The percent volume flows of the two gases were adjusted using the MFCs and their software. Gas cylinders from the following suppliers were used: Oxygen 2.5 from Nippon Gases Deutschland GmbH, Dusseldorf, and nitrogen 4.8 from Westfalen AG, Münster or nitrogen 5.0 from Nippon Gases Deutschland GmbH, Dusseldorf. The gas distributor and the gas inlet covers of the electrolysis cells are described in the literature (M. Dörr, D. Waldmann, S. R. Waldvogel, GIT Labor-Fachz. 2021, 7-8, 26-28) and were purchased from IKA (IKA-Werke GmbH & Co. KG, Staufen, Germany).

General Procedure GP1

In an undivided 5 mL Teflon pot cell the cycloalkane (0.1 to 0.5 mmol), the cycloalkene (0.5 to 0.9 mmol, alkane and alkene sum to 1 mmol) and tetrabutylammonium nitrate (0.5 eq.) were initially charged and dissolved in acetonitrile or isobutyronitrile (5 mL). The cell was fitted with glassy carbon electrodes spaced 0.5 cm apart. The immersed surface area of the electrodes is 1.8 $cm^2$. After the cell was secured in a stainless steel block a galvanostatic electrolysis was performed at 22° C. at a current density of 10 $mA/cm^2$.

The charge quantity employed was based on the theoretical charge quantities for oxidation of both components according to their ratio (alkane/alkene=0.1/0.9:7.6 F; 0.25/0.75:7.0 F: 0.5/0.5:6.0 F). After the electrolysis 1,3,5-trimethoxybenzene (10 mg) was added to the reaction solution as internal standard. Three droplets were withdrawn and filtered through silica gel 60 M (eluent: ethyl acetate). The filtrate was collected in a GC via and subjected to GC analysis. The remaining reaction solution initially had the solvent removed from it by distillation. The conductivity salt was then removed by extraction using 10 mL of ethyl acetate and 10 mL of aqueous HCl solution (0.1 M). The solvent of the organic phase was removed by distillation and the residue taken up in an aqueous NaOH solution (1 M, 10 mL). The aqueous phase was washed with 10 mL of diethyl ether. After the phase separation the aqueous phase was adjusted to pH 1 with an aqueous HCl solution (1 M) and said phase was extracted with 2×10 mL of ethyl acetate. After drying the organic phase over sodium sulfate and distillative removal of the solvent, the dicarboxylic acid product was dried under high vacuum.

Once the charge quantity had been employed, 10 mg of 1,3,5-trimethoxybenzene was added to the reaction solution as internal standard. 3 drops of the reaction solution were withdrawn for analysis by gas chromatography and quantification of the product. These were eluted through about 330 mg of silica gel 60 M using ethyl acetate. About 1.5 mL of the filtrate was collected in a GC vial and investigated for oxidation products by GC-FID and GC-MS. Quantification was achieved via prior calibration of the gas chromatograph.

EXAMPLE 1

The following co-electrolyses were performed according to GP1 (scheme 1, table 1).

Scheme 1.

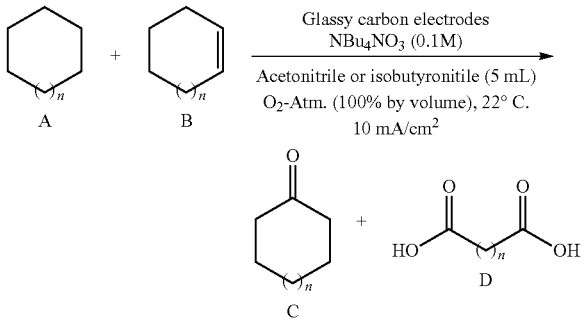

TABLE 1

Reactions for co-electrolysis

| Substrates | Mixing ratios | Products C: Cyclooctanone[d] | Products D: Octanedioic acid[e] |
|---|---|---|---|
| n = 3 | A:B = 1:9 (10 mol % A)[a] | 4% | 40% |
| | A:B = 1:3 (25 mol % A)[b] | 2% | 44% |
| | A:B = 1:1 (50 mol % A)[c] | 2% | 45% |
| n = 7 | A:B = 1:9 (10 mol % A)[a] | 27% | 57% |
| | A:B = 1:3 (25 mol % A)[b] | 13% | 63% |
| | A:B = 1:1 (50 mol % A)[c] | 9% | 74% |

For n = 3 acetonitrile was used as solvent and for n = 7 isobutyronitrile was used as solvent.
Cumulative charge quantity in respect of A and B:
[a]7.6 F;
[b]7.0 F;
[c]6.0 F.
[d]determination by external GC calibration (internal standard: 1,3,5-trimethoxybenzene).
[e]Yields isolated. All yields relate to the employed molar amounts of the particular reactant.

The invention claimed is:

1. A process for producing unsubstituted or at least monosubstituted α,ω-dicarboxylic acids or ketocarboxylic acids and unsubstituted or at least monosubstituted cycloalkanones by electrochemical oxidation, the process comprising:

(a-1) providing at least one unsubstituted or at least monosubstituted, monounsaturated or polyunsaturated cycloalkene;

(a-2) providing at least one unsubstituted or at least monosubstituted, saturated cycloaliphatic hydrocarbon, wherein substituents of the at least monounsaturated or polyunsaturated cycloalkene and substituents of the saturated cycloaliphatic hydrocarbon are each independently selected from the group consisting of methyl, phenyl and benzyl substituents, wherein the phenyl and benzyl substituents are themselves each unsubstituted or monosubstituted or polysubstituted with 1, 2 or 3 substituents, each independently selected from the group consisting of F, Cl, Br and $NO_2$, and wherein ring sizes of the cycloalkene according to (a-1) and of the cycloaliphatic hydrocarbon according to (a-2) match;

(b) providing at least one inorganic or organic nitrate salt, wherein the nitrate salt of (b) is present as a nitrate of formula [cation$^+$][$NO_3^-$], where [cation$^+$] is selected from the group consisting of $Na^+$, $K^+$, ammonium ions having structure [$R^1R^2R^3R^4N^+$] where $R^1$, $R^2$, $R^3$ and $R^4$ are each independently selected from the group consisting of $C_1$ to $C_{16}$ alkyl, imidazolium cations of structure (I)

(I)

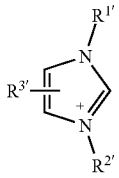

where $R^{1'}$ and $R^{2'}$ are each independently selected from the group consisting of $C_1$ to $C_{18}$ alkyl, and $R^{3'}$ is selected from the group consisting of H and $C_1$ to $C_{18}$ alkyl, pyridinium cations of structure (II)

(II)

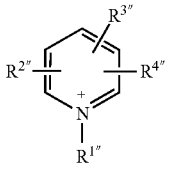

where $R^{1''}$ is selected from the group consisting of $C_1$ to $C_{18}$ alkyl and $R^{2''}$, $R^{3''}$, and $R^{4''}$ are each independently selected from the group consisting of H, and straight-chain or branched $C_1$ to $C_{18}$ alkyl, and phosphonium ions of structure [$R^{1a}R^{2a}R^{3a}R^{4a}P^+$] where $R^{1a}$, $R^{2a}$, $R^{3a}$, and $R^{4a}$ are each independently selected from the group consisting $C_1$ to $C_{16}$ alkyl, and (c) electrochemically oxidizing the at least one unsubstituted or at least monosubstituted, monounsaturated or polyunsaturated cycloalkene provided in (a-1) and the at least one unsubstituted or at least monosubstituted, saturated cycloaliphatic hydrocarbon provided in (a-2) in the presence of the at least one inorganic or organic nitrate salt provided in (b) in an electrolysis cell in a reaction medium in the presence of oxygen.

2. The process according to claim 1, wherein the at least one unsubstituted or at least monosubstituted, monounsaturated or polyunsaturated cycloalkene is monocyclic or bicyclic, wherein the at least one unsubstituted or at least monosubstituted, monounsaturated or polyunsaturated monocyclic cycloalkene has 5 to 12 carbon atoms in the ring system and is unsubstituted or monosubstituted or polysubstituted, each substituent is independently selected from the group consisting of methyl, phenyl and benzyl substituents, wherein the phenyl and benzyl substituents are themselves each unsubstituted or monosubstituted or polysubstituted with 1, 2 or 3 substituents, each independently selected from the group consisting of F, Cl, Br and $NO_2$ and/or the at least one unsubstituted or at least monosubstituted, monounsaturated or polyunsaturated bicyclic cycloalkene has 7 to 18 carbon atoms in the ring system and is unsubstituted or monosubstituted or polysubstituted, wherein each substituent is independently selected from the group consisting of methyl, phenyl and benzyl substituents, wherein the phenyl and benzyl substituents are themselves each unsubstituted or monosubstituted or polysubstituted with 1, 2 or 3 substituents, each independently selected from the group consisting of F, Cl, Br and $NO_2$.

3. The process according to claim 1, wherein the at least one unsubstituted or at least monosubstituted, saturated cycloaliphatic hydrocarbon is a monocyclic saturated hydrocarbon having 6 to 12 carbon atoms in the ring, wherein the saturated cycloaliphatic hydrocarbon is unsubstituted or monosubstituted or polysubstituted with 1, 2, 3, 4 or 5 substituents, each independently selected from the group consisting of methyl, phenyl and benzyl substituents.

4. The process according to claim 1, wherein the at least one unsubstituted or at least monosubstituted, monounsaturated or polyunsaturated cycloalkene is selected from the group consisting of cyclohexene, cycloheptene, cyclooctene, cyclononene, cyclodecene, cycloundecene, cyclododecene, 1-phenylcyclohex-1-ene, bicylo[2.2.1]hept-2-ene, α-pinene and carene, and wherein the at least one unsubstituted or at least monosubstituted, saturated cycloaliphatic hydrocarbon is selected from the group consisting of cyclohexane, cycloheptane, cyclooctane, cyclononane, cyclodecane, cycloundecane and cyclododecane.

5. The process according to claim 1, wherein a molar proportion of the at least one unsubstituted or at least monosubstituted, monounsaturated or polyunsaturated cycloalkene is 40 to 95 mol % based on a total amount of employed unsubstituted or at least monosubstituted, monounsaturated or polyunsaturated cycloalkene and unsubstituted or at least monosubstituted, saturated cycloaliphatic hydrocarbon.

6. The process according to claim 1, wherein, in the imidazolium cations of structure (I), the radicals $R^{1'}$ and $R^{2'}$ are each independently selected from the group consisting of $C_1$ to $C_{18}$ alkyl, and $R^{3'}$ is hydrogen.

7. The process according to claim 1, wherein, in the pyridinium cations of the structure (II), the radical $R^{1''}$ is $C_1$ to $C_{18}$ alkyl, and the radicals $R^{2''}$, $R^{3''}$, and $R^{4''}$ are each independently selected from the group consisting of $C_1$ to $C_8$ alkyl.

8. The process according to claim 1, wherein the at least one organic nitrate salt is selected from the group consisting of tetra-n-butylammonium nitrate, methyltri-n-octylammonium nitrate, tetra-n-butylphosphonium nitrate, methyltri-n-octylphosphonium nitrate and 1-butyl-3-methylimidazolium nitrate.

9. The process according to claim 1, wherein the reaction medium is a polar aprotic reaction medium, optionally in combination with water, wherein the polar aprotic reaction medium is selected from the group consisting of aliphatic nitriles, aliphatic ketones, cycloaliphatic ketones, dialkyl carbonates, cyclic carbonates, lactones, aliphatic nitroalkanes, dimethyl sulfoxide, esters, ethers, and mixtures of at least two of these components.

10. The process according to claim 1, wherein the reaction medium is a polar aprotic reaction medium, optionally in combination with water, wherein the water content is up to 20% by volume based on a total amount of reaction medium.

11. The process according to claim 1, wherein the reaction medium comprises one or more solubilizing components.

12. The process according to claim 1, wherein the at least one inorganic or organic nitrate salt is employed in an amount of 0.1 to 2.0 equivalents based on an amount of employed unsubstituted or at least monosubstituted, monounsaturated or polyunsaturated cycloalkene and in an amount of 0.8 to 10.0 equivalents based on an amount of employed unsubstituted or at least monosubstituted, saturated cycloaliphatic hydrocarbon.

13. The process according to claim 1, wherein a gas atmosphere containing the oxygen is advantageously provided in spatial connection with the reaction medium.

14. The process according to claim 13, wherein gas exchange between the gas atmosphere and the reaction medium is forced by introducing the gas atmosphere into the reaction medium or by stirring a liquid phase of the reaction medium in the presence of the gas atmosphere.

15. The process according to claim 1, wherein an amount of the oxygen dissolved in the reaction medium is at least 1 mmol/L.

16. The process according to claim 1, wherein the electrolysis cell is an undivided cell.

17. The process according to claim 1, wherein the electrolysis cell comprises a glassy carbon anode, a graphite anode or a boron-doped diamond anode.

18. The process according to claim 1, wherein a charge quantity is at least 190 C (2 F) to 970 C (10 F), for 1 mmol of employed unsubstituted or at least monosubstituted, monounsaturated or polyunsaturated cycloalkene and unsubstituted or at least monosubstituted, saturated cycloaliphatic hydrocarbon.

19. The process according to claim 1, wherein the electrochemical oxidation is carried out at a temperature in a range from 0° C. to 60° C.

20. The process according to claim 1, wherein said process is performed without an addition of a catalyst.

21. The process according to claim 1, wherein said process is performed continuously and said electrolysis cell is an undivided flow-through electrolysis cell.

* * * * *